US005843632A

United States Patent [19]

Eshelman et al.

[11] Patent Number: 5,843,632

[45] Date of Patent: Dec. 1, 1998

[54] PHOTOTHERMOGRAPHIC COMPOSITION OF ENHANCED PHOTOSENSITIVITY AND A PROCESS FOR ITS PREPARATION

[75] Inventors: Lyn M. Eshelman, Penfield; Mark E. Irving, Rochester; David H. Levy, Rochester; Kathleen R. C. Gisser, Rochester, all of N.Y.

[73] Assignee: Eastman Kodak Company, Rochester, N.Y.

[21] Appl. No.: 883,734

[22] Filed: Jun. 27, 1997

[51] Int. Cl.[6] ..... G03C 1/498

[52] U.S. Cl. ..... 430/619; 430/600; 430/603

[58] Field of Search ..... 430/569, 619, 430/600, 603

[56] References Cited

U.S. PATENT DOCUMENTS

| | | |
|---|---|---|
| 3,700,458 | 10/1972 | Lindholm . |
| 3,713,833 | 1/1973 | Lindholm et al. . |
| 3,871,887 | 3/1975 | Jones . |
| 3,887,597 | 6/1975 | Ohkubo et al. . |
| 3,909,271 | 9/1975 | Ikenoue et al. . |
| 4,207,108 | 6/1980 | Hiller . |
| 4,276,374 | 6/1981 | Mifune et al. . |
| 4,435,499 | 3/1984 | Reeves . |
| 4,478,927 | 10/1984 | Naito et al. . |
| 4,639,414 | 1/1987 | Sakaguchi . |
| 4,725,534 | 2/1988 | Kagami et al. . |
| 4,749,646 | 6/1988 | Herz et al. . |
| 4,751,176 | 6/1988 | Pham . |
| 4,810,626 | 3/1989 | Burgmaier et al. . |
| 4,923,794 | 5/1990 | Sasaki et al. . |
| 5,028,522 | 7/1991 | Kojima et al. . |
| 5,049,485 | 9/1991 | Deaton . |
| 5,114,838 | 5/1992 | Yamada . |
| 5,116,723 | 5/1992 | Kajiwara et al. . |
| 5,158,892 | 10/1992 | Sasaki et al. . |
| 5,164,292 | 11/1992 | Johnson et al. . |
| 5,168,035 | 12/1992 | Lushington et al. . |
| 5,198,331 | 3/1993 | Takaguchi et al. . |
| 5,210,002 | 5/1993 | Adin . |
| 5,215,880 | 6/1993 | Kojima et al. . |
| 5,229,264 | 7/1993 | Patzold et al. . |
| 5,236,821 | 8/1993 | Yagihara et al. . |
| 5,238,807 | 8/1993 | Sasaki et al. . |
| 5,254,456 | 10/1993 | Yamashita et al. . |
| 5,283,168 | 2/1994 | Kojima et al. . |
| 5,306,613 | 4/1994 | Yagihara et al. . |
| 5,393,655 | 2/1995 | Sasaki et al. . |
| 5,434,042 | 7/1995 | Fujiwara . |
| 5,434,043 | 7/1995 | Zou et al. . |

OTHER PUBLICATIONS

Research Disclosure, vol. 389, Sep. 1996, item 38957.
Research Disclosure vol. 170, Jun. 1978, Item 17029.

*Primary Examiner*—Thorl Chea
*Attorney, Agent, or Firm*—Carl O. Thomas

[57] ABSTRACT

A photothermographic composition of enhanced photosensitivity is disclosed prepared by a process of (a) precipitating light-sensitive silver halide grains in the presence of a non-aqueous polymeric peptizer and (b) then combining the silver halide grains with a non-aqueous polymeric vehicle containing an oxidation-reduction image-forming combination comprised of an organic silver compound and a reducing agent for the organic silver compound. Light-sensitivity of the silver halide grains is enhanced by, prior to step (b), sensitizing the silver halide grains with a 1,1,3,3-tetra-substituted thiourea or selenourea having an acid dissociation constant of less than 7.0, the thiourea or selenourea being dissolved in an aqueous medium.

17 Claims, No Drawings

PHOTOTHERMOGRAPHIC COMPOSITION OF ENHANCED PHOTOSENSITIVITY AND A PROCESS FOR ITS PREPARATION

FIELD OF THE INVENTION

The invention relates to a photothermographic composition of enhanced photosensitivity containing silver halide grains and to a process for its preparation.

DEFINITION OF TERMS

In referring to silver halide grains and emulsions containing two or more halides, the halides are named in order of ascending concentrations.

The term "photothermographic" in referring to compositions and elements indicates those that form an image when imagewise exposed to light and then uniformly heated.

The term "photographic" in referring to compositions and elements indicates those that form an image when imagewise exposed to light and brought into contact with an aqueous developer.

The term "grain size" is used to indicate mean grain equivalent circular diameter (ECD), where ECD is the diameter of a circle having an area equal to the grain projected area.

The term "peptizer" is used to indicate a material that physically interacts with silver halide grain surfaces to reduce grain clumping or settling from suspension in a liquid medium.

The term "vehicle" is used to indicate the material forming the continuous phase of a composition or layer containing silver halide grains. In a dried coating the vehicle is principally comprised of binder, peptizer and dispersed addenda, whereas prior to coating the vehicle additionally includes the liquids that are removed in drying.

The term "aqueous medium" is used to indicate water or an aqueous solution, optionally additionally containing other, water miscible solvents.

The term "non-aqueous" in referring to peptizers and vehicles refers to media that are immiscible with water.

The term "acid dissociation constant" or "pKa" is herein defined as the negative logarithm of the product at 25° C. in aqueous solutions of the activities of the dissociated protons and anionic moieties of an acid divided by the activities of the undissociated acid. This is the standard definition, as illustrated by Daniels and Alberty, *Physical Chemistry*, 3rd Ed., John Wiley and Sons, N.Y., 1966, pp. 218 and 219.

*Research Disclosure* is published by Kenneth Mason Publications, Ltd., Dudley House, 12 North St., Emsworth, Hampshire P010 7DQ, England.

BACKGROUND

In its most common form silver halide photography employs silver halide grains that are precipitated in the presence of an aqueous gelatino-peptizer. After precipitation the grains are chemically sensitized and, if desired, spectrally sensitized. The emulsion is coated on a support to form a photographic element. Following imagewise exposure the photographic element is brought into contact with one or more aqueous processing solutions. During aqueous processing a developing agent is relied on to reduce silver halide to silver imagewise as a function of light exposure and, in color photography, to create a dye image.

Silver halide photographic elements and their chemical sensitization are summarized in *Research Disclosure*, Vol. 389, September 1996, Item 38957. Common chemical sensitizations are summarized in Section IV. Chemical sensitizers are generally assigned to three broad categories: (1) noble metal sensitizers, including gold and Group VIII metals, (2) middle chalcogen sensitizers, including sulfur, selenium and tellurium sensitizers, and (3) reduction sensitizers.

Sulfur and selenium sensitizers contain at least one sulfur or selenium atom in a labile, divalent form. The labile sulfur or selenium atom is believed to form upon heating in the presence of silver halide grains silver sulfide or selenide, which is responsible for increasing the photosensitivity of the grains. A general discussion of sulfur and selenium sensitizers, particularly the former, and their mechanism of sensitization is provided by Haribson and Spencer in Chapter 5. Chemical Sensitization and Environmental Effects, particularly Section C. Sulfur Sensitization, of James *The Theory of the Photographic Process*, 4th Ed., Macmillan, N.Y., 1977. A further summary of conventional sulfur and selenium sensitizers in contained in *Research Disclosure*, Vol. 389, Sept. 1996, Item 38957, IV. Chemical sensitization. Common sulfur sensitizers include thiosulfates, thiosulfonates, thiocyanates, selenocyanates, isothiocyanates, thioethers, thioureas, selenoureas, cysteine and rhodanine.

The following illustrate middle chalcogen sensitizers for silver halide emulsions:

Sulfur

Mifune et al U.S. Pat. No. 4,276,374
Herz et al U.S. Pat. No. 4,749,646
Burgmaier et al U.S. Pat. No. 4,180,626
Yamada U.S. Pat. No. 5,114,838
Kajiwara et al U.S. Pat. No. 5,116,723
Lushington U.S. Pat. No. 5,168,035
Takaguchi et al U.S. Pat. No. 5,198,331
Adin U.S. Pat. No. 5,210,002
Pätzold et al U.S. Pat. No. 5,229,264
Yamashita et al U.S. Pat. No. 5,254,456
Kojima et al U.S. Pat. No. 5,283,168

Selenium

Kojima et al U.S. Pat. No. 5,028,522
Johnson et al U.S. Pat. No. 5,164,292
Sasaki et al U.S. Pat. No. 5,158,892
Tagahara et al U.S. Pat. No. 5,236,821
Saskai et al U.S. Pat. No. 5,238,807
Fujiwara U.S. Pat. No. 5,434,042

Tellurium

Sasaki et al U.S. Pat. No. 4,923,794
Kojima et al U.S. Pat. No. 5,215,880
Yagahara et al U.S. Pat. No. 5,306,613
Sasaki et al U.S. Pat. No. 5,393,655

Since sulfur is a common element, it is often included in gold and reduction sensitizers, but may not function as a sulfur sensitizer. For example, 1,1,3,3,-tetra-substituted thioureas are common sulfur sensitizers, but thiourea dioxide is a reduction sensitizer and compounds of type disclosed by Deaton U.S. Pat. No. 5,049,485, which include substituted thiourea ligands linked through their sulfur atoms to gold, are gold sensitizers only, since the sulfur is not present in an active, labile form. Other compounds, such as gold sulfide and gold dithiosulfate, are known which are capable of functioning simultaneously as both sulfur and gold sensitizers.

The advantage of photographic imaging as described above is that the highest attainable levels of photosensitivity are realized. A significant disadvantage is the requirement of bringing the photographic elements into contact with an aqueous processing solution during development—i.e., "wet" processing.

A way of avoiding wet processing is to employ a photosensitive element that can create a viewable "dry" image simply by being heated following imagewise exposure. *Research Disclosure*, Vol 170, June 1978, Item 17029, provides a summary of the many varied common photothermographic imaging systems. These photothermographic imaging systems have been broadly divided into Systems A and B.

In System A the photothermographic composition is comprised of photosensitive silver halide grains that are relied upon as the sole source of silver. System A has the advantage of being able to employ aqueous silver halide emulsions of the type employed in silver halide photographic systems, with their superior photosensitivity.

Photothermographic imaging systems predominantly fall into the System B category. The minimum essential components of System B are the following:

(a) photosensitive silver halide grains, (b) an oxidation-reduction image-forming combination comprised of (i) an organic silver compound and (ii) an organic reducing agent and (c) a vehicle.

The organic silver compounds that are most efficiently catalyzed by light-exposed silver halide grains to enter into an oxidation-reduction reaction in response to heating are those that are most conveniently dispersed in non-aqueous polymeric vehicles. Thus, although techniques are known for combining aqueous silver halide emulsions with the oxidation-reduction combination, the disadvantages of combining silver halide grains precipitated in an aqueous peptizer with a non-aqueous polymeric vehicle containing the oxidation-reduction combination more than offset any advantage of this approach. Therefore, it is generally preferred and most convenient to form the silver halide grains of component (a) in the presence of a non-aqueous polymeric peptizer.

Silver halide grains are formed in the presence of non-aqueous polymeric peptizer using either in situ or ex situ techniques. The in situ technique converts a portion of the organic silver compound (i) of the oxidation-reduction combination (b) to silver halide. The disadvantage of this technique is that chemical sensitization of the silver halide to increase photosensitivity is difficult. Typically chemical sensitization involves (1) adding a chemical sensitizing compound and (2) holding the silver halide at an elevated temperature for a period sufficient to allow interaction of the silver halide and the sensitizer. Since the in situ formation of the silver halide requires the presence of the organic silver compound, which is necessarily heat sensitive, it is apparent that heating runs the risk of unwanted silver ion release, thereby degrading image quality.

This disadvantage is avoided by undertaking ex situ silver halide grain formation, wherein, by definition, the organic silver compound is not present while the silver halide grains are being prepared. In addition, silver halide grain formation in the absence of the organic silver compound is generally simpler and more convenient than in situ grain formation.

In most instances photothermographic compositions are prepared and used without employing any chemical sensitization step comparable to that employed in preparing silver halide photographic emulsions. This is because silver halide photothermographic compositions are generally much slower than silver halide photographic compositions and have been commonly relegated to imaging applications that are compatible with low imaging speeds.

*Research Disclosure*, Item 17029, cited above, Section VI. Chemical Sensitization/Speed Addenda discloses a variety of sensitizations that have been developed for chemically sensitizing silver halide emulsions containing non-aqueous polymeric peptizers and silver halide formed in the non-aqueous polymeric vehicles of System B.

The following patents particularly directed to photothermography have been considered:

I. System A photothermographic systems, aqueous silver halide precipitations and vehicle:
Sakaguchi U.S. Pat. No. 4,639,414.

II. System B photothermographic systems, aqueous silver halide precipitations:
Lindholm et al U.S. Pat. No. 3,700,458;
Ikenoue et al U.S. Pat. No. 3,909,271;
Reeves et al U.S. Pat. No. 4,435,499; and
Zou et al U.S. Pat. No. 5,434,043.

III. System B photothermographic systems, in situ silver halide precipitation:
Obkubo et al U.S. Pat. No. 3,887,597 and
Naito et al U.S. Pat. No. 4,478,927.

IV. System B photothermographic systems, ex situ silver halide precipitation in non-aqueous polymeric peptizer:
Lindholm et al U.S. Pat. No. 3,713,833;
Jones U.S. Pat. No. 3,871,887;
Hiller U.S. Pat. No. 4,207,108;
Kagami et al U.S. Pat. No. 4,725,534; and
Pham U.S. Pat. No. 4,751,176.

RELATED APPLICATION

Lushington and Gysling U.S. Ser. No. 08/868,652 (Docket 74387), filed Jun. 4, 1997, now U.S. Pat. No. 5,759,761, titled GOLD CHEMICAL SENSITIZERS FOR SILVER HALIDES, commonly assigned, is directed to silver halide grains sensitized with at least one gold compound of the formula:

$$\{AuS_2X\}_n$$

wherein

X is $PR_2$, $P(OR)_2$, COR, $CNR_2$ or CR;

R is alkyl or aryl; and n is an integer of from 1 to 6.

SUMMARY OF THE INVENTION

In one aspect this invention is directed to a process of preparing a photothermographic composition of enhanced photosensitivity comprised of (a) precipitating light-sensitive silver halide grains in the presence of a non-aqueous polymeric peptizer and (b) then combining the silver halide grains with a non-aqueous polymeric vehicle containing an oxidation-reduction image-forming combination comprised of an organic silver compound and a reducing agent for the organic silver compound, wherein light-sensitivity of the silver halide grains is enhanced by, prior to step (b), sensitizing the silver halide grains with a 1,1,3,3-tetra-substituted thiourea or selenourea, at least one substituent of which contains an acid moiety sensitizer dissolved in an aqueous medium.

In another aspect, this invention is directed to a photothermographic composition comprised of (a) photosensitive silver halide grains; (b) an oxidation-reduction image-forming combination comprised of (i) an organic silver compound and (ii) an organic reducing agent; and (c) a non-aqueous polymeric dispersing medium, wherein the silver halide grains are chemically sensitized with a 1,1,3,3-tetra-substituted thiourea or selenourea, at least one substituent of which contains an acid moiety.

The "1,1,3,3-tetra-substituted thiourea or selenourea, at least one substituent of which contains an acid moiety" is also hereinafter referred to as the "selected sensitizer".

It has been discovered quite unexpectedly that superior levels of photosensitivity are realized when a selected sensitizer is dissolved in an aqueous medium and then brought into contact with silver halide grains formed ex situ in a non-aqueous polymeric peptizer. Whereas it would seem logical that the same types of organic dispersing media employed in combination with non-aqueous polymeric peptizers and vehicles would provide a more intimate association of the silver halide grains and sulfur sensitizers and therefore lead to superior levels of photosensitivity, this intuitively obvious observation has, in fact, been found to be in error. Instead, dissolving the selected sensitizer in water is shown in the Examples below to provide superior photosensitivity.

Further, it has been observed that the selected sensitizer provides superior levels of photosensitivity as compared to other, conventional sulfur sensitizers that are commonly dispersed in aqueous media when performing chemical sensitization. For example, photosensitivity is higher in the photothermo-graphic compositions of the invention than when a conventional water dispersed sulfur sensitizer, such as sodium thiosulfate is employed. The observed unusually high levels of photosensitivity in photothermographic compositions that employ non-aqueous polymeric dispersing media were entirely unexpected.

DESCRIPTION OF PREFERRED EMBODIMENTS

The present invention is directed to a process of preparing a photothermographic composition that exhibits enhanced photosensitivity. This is achieved by the ex situ precipitation of silver halide grains in a non-aqueous polymeric peptizer, followed by chemical sensitization with a selected sensitizer dissolved in an aqueous medium. The resulting sensitized silver halide emulsion is then blended with an oxidation-reduction image-forming combination comprised of an organic silver compound and a reducing agent for the organic silver compound. Further enhancements in photosensitivity can be realized by combining a gold sensitizer with the selected sensitizer. The photothermographic compositions produced by the process of the invention are compatible with other conventional components of photothermographic elements containing ex situ silver halide grains formed in the presence of a non-aqueous polymeric peptizer.

The ex situ precipitation of silver halide grains in the presence of a non-aqueous polymeric peptizer can be undertaken by any convenient conventional technique. Such precipitations can be conducted, for example, according to the teachings of Lindholm et al U.S. Pat. No. 3,713,833, Jones U.S. Pat. No. 3,871,887, Hiller U.S. Pat. No. 4,207,108, Kagami et al U.S. Pat. No. 4,725,534, and Pham U.S. Pat. No. 4,751,176, cited above and here incorporated by reference. Still another teaching is provided by *Research Disclosure*, Vol. 125, September 1974, Item 12537.

A large variety of non-aqueous polymeric peptizers are known to be useful for the ex situ precipitation of the silver halide grains. These peptizers, variously referred to in the art as organic resins, synthetic polymers and hydrophobic polymers include those derived from monomers of amides or esters of ethylenically unsaturated acids, including maleic acids, acrylic acids and methacrylic acids. Monomers of this type with pendant thiaalkyl pendant groups are disclosed by Lindholm et al U.S. Pat. No. 3,713,833. Jones U.S. Pat. No. 3,871,887 additionally discloses to be useful as peptizers vinylpyridine polymers, such as those derived from 2-vinylpyridine, 4-vinylpyridine and 2-methyl-5-vinylpyridine monomers.

Preferred non-aqueous polymeric peptizers are poly(vinyl acetals), such as poly(vinyl acetal) and poly(vinyl butyral). Specifically preferred poly(vinyl acetals) are copolymers synthesized in the presence of minor amounts of other monomers that optimize physical properties. For example, Butvar™, available from Monsanto, includes types B-72, B-73, B-74, B-76, B-79, B-90 and B-98, each of which can be employed as peptizers in the practice of this invention, include from 80 to 88 mole percent vinyl butyral derived repeating units, from 0 to 2.5 mole percent vinyl alcohol derived repeating units, and 10 to 20 mole percent vinyl acetate derived repeating units. Selections of poly(vinyl acetal) copolymers for optimum physical properties are disclosed in Hazalik et al U.S. Pat. Nos. 5,340,613, 5,378,542 and 5,415,993, the disclosures of which are here incorporated by reference.

The non-aqueous polymeric peptizers are dispersed in a volatile organic solvent Preferably the polymeric peptizers are within a molecular weight range of from 10,000 to 500,000, most preferably from 30,000 to 250,000. The volatile organic solvent is chosen to be removable from the composition by heating to a temperature of less than 165° C., preferably less than 90° C. Only small levels of peptizer are required to hold silver halide grains in suspension. Peptizer concentrations prior to silver halide grain formation can range as low as 0.1 percent by weight, based on the weight of the volatile organic solvent. Seldom are peptizer concentrations above 20 percent by weight, based on the weight of the solvent, required. A preferred range of peptizer concentrations is from about 1 to 10 percent by weight, based on organic solvent weight.

A wide range of volatile organic solvents are known and available for use. Typically the solvents are chosen from among alcohols, ketones, esters, ethers, aliphatic hydrocarbons, aromatic hydrocarbons, and amides, either employed alone or in combination. The alcohols include both glycols and glycerols. A listing of typical useful volatile organic solvents is contained in Kagami et al U.S. Pat. No. 4,725,534, cited above, the disclosure of which is here incorporated by reference.

The ex situ precipitation of silver halide grains is accomplished by introducing a silver salt, such as silver nitrate, silver trifluoroacetate or silver perchlorate, and one or a combination of halide salts, such as an ammonium or alkali halide, into the volatile organic solvent containing the non-aqueous polymeric peptizer. The silver halide grains formed include silver chloride, silver bromide, silver bromochloride, silver chlorobromide, silver iodochloride, silver iodobromide, silver iodobromocloride, silver iodochlorobromide, silver bromoiodochloride and silver chloroiodobromide. Preferably iodide is limited to less than 10 mole percent, optimally less than 5 mole percent, based on total silver forming the silver halide grains.

Precipitation is continued until the grains reach a size that satisfies the requirements of the imaging application contemplated. As is generally well understood in the art, the photosensitivity of silver halide grains increases as grain size increases. Unfortunately, image noise (granularity) also increases with increasing grain size. Thus, grain sizes are generally chosen to arrive at an optimum balance between photosensitivity and image noise. For microfilm, which particularly benefits from minimal image noise, grain sizes can range down to Lippmann levels—e.g., down to about 0.05 $\mu$m. At the other extreme, for higher speed imaging grain sizes of up to 5 $\mu$m are contemplated to maximize image speed. Reeves U.S. Pat. No. 4,435,499, cited above and here incorporated by reference, discloses tabular grains extending to even larger grain sizes to be useful in photothermographic imaging.

Following precipitation of the silver halide grains, they are chemically sensitized by addition of one or more of the selected sensitizers and holding at an elevated temperature. The selected sensitizer is dissolved in an aqueous medium. When the aqueous medium containing the selected sensitizer partitions as a separate phase (i.e., is immiscible with) the volatile organic solvents employed with the non-aqueous polymeric peptizer for the silver halide grains, as is usually the case, vigorous stirring is required to bring the gold sensitizer into proximity with the silver halide grains. Agitation is required throughout the interval during which chemical sensitization is occurring. Conventional vigorous stirring mechanisms of the type employed during silver halide precipitation are contemplated for use during chemical sensitization. Chemical sensitization is typically undertaken in the temperature range of from 30° to 90° C., preferably 40° to 70° C. Optimum sensitizations are conventionally achieved by subjecting small alloquats of the emulsion to different time and temperature profiles. The highest attainable speed that is compatible with minimum density requirements is taken as the optimum sensitization. In comparing the speeds of emulsions sensitized by different techniques, the emulsions are finished to at least approximately the same minimum density.

The selected sensitizers employed in the practice of the invention are 1,1,3,3-tetra-substituted thioureas and selenoureas having an acid dissociation constant (pKa) of less than 7, typically in the range of from 2 to 5. To provide a convenient point of reference, phosphoric acid has a pKa of 2.12 while acetic acid has a pKa of 4.75. A listing of the pKa's of weak organic acids in water is provided in the *Handbook of Chemistry and Physics*, 54th Ed., CRC Press, 1973, p. D-129.

Sensitizers that fall into this class are disclosed by Herz et al U.S. Pat. No. 4,749,646, Burgmaier et al U.S. Pat. No. 4,810,626 and Adin U.S. Pat. No. 5,210,002, cited above, the disclosures of which are here incorporated by reference.

The preferred selected sensitizers satisfy the formula:

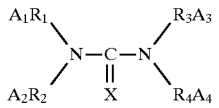

wherein

X is sulfur or selenium;

each of $R_1$, $R_2$, $R_3$ and $R_4$ independently represents a hydrocarbon linking group containing from 1 to 10 carbon atoms, preferably 1 to 6 carbon atoms;

$A_1$ and $A_2$ together contain the non-metallic atoms necessary to complete with $R_1$ and $R_2$ a 5 or 6 member ring or independently represent hydrogen or an acidic group; and $A_3$ and $A_4$ independently represent hydrogen or a radical comprising an acidic group;

with the proviso that at least one of $A_1$ to $A_4$ is an acidic group.

The hydrocarbon linking groups ($R_1$ to $R_4$) can be independently selected from among allylene, cycloalkylene, alkarylene, aralkylene and arylene groups. The following are exemplary preferred hydrocarbon linking groups: methylene, ethylene, propylene, iso-propylene, butylene, iso-butylene, tert-butylene, pentylene, iso-pentylene, neopentylene, 1,4-cyclopentylene, 1,4-cyclohexylene, p-phenylene.

$A_1$ and $A_2$ together with $R_1$ and $R_2$ can complete a 5 or 6 member heterocyclic ring containing the nitrogen atom the formula above. Oxygen and sulfur heteroatoms in addition to the required nitrogen heteroatom can also be included in the heterocyclic ring. Typical preferred rings include pyridine, morpholine, piperidine and diazine.

The acid group or groups are chosen to satisfy the acidity requirements noted above. Preferred acid groups include —C(O)OH, —$SO_2$OH, —$SO_3$OH and —NHOH. The acid groups can conveniently take the form of alkali, alkaline earth or ammonium salts. Water dissociable organic salts are also contemplated.

Specific examples of useful formula (I) compounds are provided in Table I:

TABLE I

| Cmpd. | $A_1R_1$ | $A_2R_2$ | $R_3A_3$ | $R_4A_4$ |
|---|---|---|---|---|
| S-1 | $CH_3$— | $CH_3$— | —$CH_3$ | —$CH_2CO_2H$ |
| S-2 | $CH_3$— | $CH_3$— | —$CH_2CO_2H$ | —$CH_2CO_2H$ |
| S-3 | $CH_3$— | $HO_2CCH_2$— | —$CH_3$ | —$CH_2CO_2H$ |
| S-4 | $CH_3$— | $HO_2CCH_2$— | —$C_2H_5$ | —$C_2H_4CO_2H$ |
| S-5 | $CH_3$— | $CH_3$— | —$C_2H_4CO_2H$ | —$C_2H_4CO_2H$ |
| S-6 | $CH_3$— | $HO_2CC_2H_4$— | —$CH_3$ | —$C_2H_4CO_2H$ |
| S-7 | $CH_3$— | $CH_3$— | —$CH_3$ | —$C_2H_4CO_2H$ |
| S-8 | $CH_3$— | $C_6H_5$— | —$CH_3$ | —$CH_2CO_2H$ |
| S-9 | $CH_3$— | $CH_3$— | —$CH_3$ | —$CH_2SO_2H$ |
| S-10 | $CH_3$— | $CH_3$— | —$CH_3$ | —$CH_2SO_2H$ |
| S-11 | $CH_3$— | $CH_3$— | —$CH_3$ | —$CH_2SO_2H$ |
| S-12 | | —$C_4H_8$— | —$CH_3$ | —$CH_2CO_2H$ |
| S-13 | $CH_3$— | $CH_3$— | —$CH_3$ | —$C_2H_4NHOH$ |
| S-14 | $CH_3$— | $CH_3$— | —$CH_3$ | —$C_2H_4SH$ |
| S-15 | | —$C_2H_4N(CH_3)C_2H_4$— | —$CH_3$ | —$CH_2CO_2H$ |
| S-16 | | —$C_2H_4OC_2H_4$— | —$C_2H_4CO_2H$ | —$C_2H_4CO_2H$ |
| S-17 | $CH_3$— | $C_6H_{11}$— | —$CH_3$ | —$CH_2CO_2H$ |

TABLE I-continued

| Cmpd. | $A_1R_1$ | $A_2R_2$ | $R_3A_3$ | $R_4A_4$ |
|---|---|---|---|---|
| S-18 | $CH_3$— | $CH_3$— | —$CH_3$ | —$C_2H_4NHA^*$ |
| S-19 | $CH_3$— | $CH_3$— | —$CH_3$ | —$C_2H_4NHCH_3$ |
| S-20 | $CH_3$— | $CH_3$— | —$C_2H_5$ | —$C_2H_4CO_2H$ |
| S-21 | $CH_3$— | $HO_2CC_2H_4$— | —$CH_3$ | —$C_2H_4CO_2H$ |
| S-22 | $CH_3$— | $HO_2CC_4H_8$— | —$C_2H_5$ | —$C_4H_8CO_2H$ |
| S-23 | $HO_2CC_3H_6$— | $HO_2CC_3H_6$— | —$C_3H_6CO_2H$ | —$C_3H_6CO_2H$ |
| S-24 | $CH_3$— | $CH_3$— | —$CH_3$ | —$C_3H_6SO_3H$ |
| S-25 | $CH_3$— | $CH_3$— | —$CH_3$ | —$B^*CO_2H$ |

$A^*$= —$SO_2CH_3$
$B^*$= —$C_2H_4C(CH_3)_2$—

In preferred formula (I) compounds X═ is S═.

In addition to chemical sensitization the silver halide grains can, if desired, be spectrally sensitized. Spectral sensitization and spectral sensitizing dyes are disclosed in *Research Disclosure*, Item 38957, cited above, Section V.A. Spectral sensitizing dyes. Particularly useful in emulsions containing non-aqueous polymeric peptizers, as herein contemplated, are the selections of spectral sensitizing dyes disclosed by *Research Disclosure*, Item 17029, cited above, IX. Spectral Sensitization, System B.

The sensitized silver halide grains and the medium in which they are suspended, including non-aqueous polymeric peptizer and organic solvent, are then added to a non-aqueous polymeric vehicle containing an oxidation-reduction image-forming combination comprised of an organic silver compound and a reducing agent for the organic silver compound.

A summary of useful organic silver compounds is provided in *Research Disclosure*, Item 17029, cited above, Section II. Metallic Salt or Complex of an Organic Compound as An Oxidizing Agent. Unlike the sensitized silver halide grains, the organic silver compound is not relied upon for light-sensitivity. The organic silver compound is comparatively stable to light, but forms a silver image when heated to 80° C. or higher in the presence of an exposed photocatalyst (such as silver halide) and a reducing agent.

Suitable organic silver compounds include silver salts of organic compounds having a carboxyl group. Preferred examples thereof include silver salts of aliphatic and aromatic carboxylic acids. Preferred examples of the silver compounds of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver compounds which are substitutable with a halogen atom or a hydroxyl group can also be effectively used. Preferred examples of the silver compounds of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in Sullivan et al U.S. Pat. No. 3,785,830, and silver compounds of an aliphatic carboxylic acid containing a thioether group as described in Weyde et al U.S. Pat. No. 3,330,663.

Silver compounds containing mercapto or thione groups and derivatives thereof can be used. Preferred examples of these compounds include a silver compound of 3-mercapto-4-phenyl-1,2,4-triazole, a silver compound of 2-mercaptobenzimidazole, a silver compound of 2-mercapto-5-aminothiadiazole, a silver compound of 2-(2-ethyl-glycolamido)benzothiazole, a silver compound of thioglycolic acid such as a silver compound of a S-alkylthioglycolic acid (wherein the alkyl group has from 12 to 22 carbon atoms) as described in Japanese patent publication No. 28221/73, a silver compound of a dithiocarboxylic acid such as a silver compound of dithioacetic acid, a silver compound of thioamide, a silver compound of 5-carboxylic-1-methyl-2-phenyl-4-thiopyridine, a silver compound of mercaptotriazine, a silver compound of 2-mercaptobenzoxazole, a silver compound as describe in Knight et al U.S. Pat. No. 4,123,274, for example a silver compound of 1,2,4-mercaptothiazole derivative such as a silver compound of 3-amino-5-benzylthio-1,2,4-thiazole, a silver compound of a thione compound such as a silver compound of 3-(2-carboxyethyl)-4-methyl-4-thiazoline-2-thione as disclosed in Humphlett et al U.S. Pat. No. 3,301,678.

Furthermore, a silver compound of a compound containing an imino group can be used. Preferred examples of these compounds include a silver compound of benzothiazole and a derivative thereof as described in Japanese patent publications Nos. 30270/69 and 18146/70, for example, a silver compound of benzothiazole such as silver compound of methylbenzotriazole, etc., a silver compound of a halogen substituted benzotriazole, such as a silver compound of 5-chlorobenzotriazole, etc., a silver compound of 1,2,4-triazole, of 1H-tetrazole as described in deMauriac U.S. Pat. No. 4,220,709, a silver compound of imidazole and an imidazole derivative, and the like.

It is also found convenient to use silver half soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. The method used for making silver soap dispersions is well known in the art and is disclosed in *Research Disclosure*, Vol 234, October 1983, Item 23419, and Gabrielson et al U.S. Pat. No. 3,985,565.

The reducing agent for the organic silver salt may be any material, preferably an organic material, that can reduce silver ion to metallic silver. Conventional photographic developers such as 3-pyrazolidinones, hydroquinones, and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis(ethoxyethyl)hydroxylamine, piperidinohexose reductone or formyl-4-methylphenylhydrazine, hydroxamic acids such as phenylhydroxamic acid, p-hydroxyphenylhydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-o-naphthols as illustrated by 2,2'-dihydroxyl-1-binaphthyl, 6,6'-dibromo-2,2'-dihydroxy-1,1'-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone; reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bis-phenols, e.g., bis(2-hydroxy-3-t-butyl-5-methylphenyl)methane; 2,2-bis(4-hydroxy-3-methylphenyl)-propane; 4,4-ethylidene-bis(2-t-butyl-6-methylphenol); and 2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; 3-pyrazolidones; and certain indane-1,3-diones.

In addition to the organic silver compound and the reducing the agent the vehicle typically additionally includes a binder dispersed in a volatile organic solvent. The same non-aqueous polymers and volatile organic solvents described above in connection with the light-sensitive silver halide grain emulsions can be employed and are preferred. Thus, after the combining step (b) of the process of the invention is performed, the peptizer and binder components of the vehicle become indistinguishable. It is, of course, appreciated that a still broader range of polymers are useful as binders, since the binders are employed primarily for optimizing the physical properties of photothermographic layers rather than silver halide grain suspension. Thus, hydrophobic polymers that can be homogeneously distributed within the photothermographic composition as well as latices are contemplated. Common latex forming polymers employed as binder extenders are disclosed in *Research Disclosure*, Item 38957, II.C. Other vehicle components.

The light-sensitive silver halide grains are preferably coated to form from 0.01 to 15 percent by weight of a photothermographic layer, although higher amounts of up to 20 or even 25 percent of the emulsion layer weight are useful. It is most preferred to coat the silver halide to account for from 1 to 10 (optimally 1.5 to 7) percent of the total weight a photothermographic layer. The silver compound forming the oxidizing agent of the oxidation-reduction combination typically accounts for from 20 to 70 (preferably 30 to 55) percent of the total weight of a photothermographic layer. The reducing agent of the oxidation-reduction combination typically accounts for from 1 to 15 (preferably 2 to 10) percent, based on the total weight of a photothermographic layer. The remainder of each photothermographic layer can be accounted for by the peptizer and binder forming the vehicle as well as conventional performance enhancing addenda, where employed. The volatile organic solvents can be present in photothermographic compositions in any proportions providing composition viscosities convenient for blending and coating, since the organic solvents are removed by evaporation after coating.

In forming viewable silver images, tone modifiers, such as those illustrated by *Research Disclosure*, Item 17029, cited above, V. Tone Modifiers, are particularly important to modifying silver particle formation during development and hence providing a more uniform and pleasing image tone. Examples of toners include phthalimide and N-hydroxyphthalimide; cyclic imides such as succinimide, pyrazoline-5-ones and a quinazolinone 1-phenylurazole, 3-phenyl-2-pyrazoline-5-one, quinazoline and 2,4-thiazolidinedione; naphthalimides such as N-hydroxy-1,8-naphthalimide; cobalt complexes such as cobaltic hexamine trifluoroacetate; mercaptans as illustrated by 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboximides, e.g., (N-dimethylaminomethyl)-phthalimide, and N-(dimethylaminomethyl)naphthalene-2,3-dicarboximide; and a combination of blocked pyrazoles, isothiuronium derivatives and certain photobleach agents, e.g., a combination of N,N'-hexamethylene-bis(1-carbamoyl-3,5-dimethylpyrazole), 1,8-(3,6-diazaoctane)bis(isothiuronium) trifluoroacetate and 2-(tribromomethylsulfonyl benzothiazole); and merocyanine dyes such as 3-ethyl-5[(3-ethyl-2-benzothiazolnylidene)-1-methyl-ethylidene]-2-thio-2,4-o-azolidinedione; phthalazine and phthalazine derivatives; 1-(2H)-phthalazinone and 1-(2H)-phthalazinone derivatives or metal salts of these derivatives such as 4-(1-naphthyl)phthalazinone, 6-chlorophthalazinone, 5,7-dimethoxyphthalazinone, and 2,3-dihydro-1,4-phthalazinedione; a combination of phthalazinone plus phthalic acid derivatives, e.g., phthalic acid, 4-methylphthalic acid, 4-nitrophthalic acid, and tetrachlorophthalic anhydride; quinazolinediones, benzoxazine or naphthoxazine derivatives; rhodium complexes such as ammonium hexachlororhodate (III), rhodium bromide, rhodium nitrate and potassium hexachlororhodate (III); inorganic peroxides and persulfates, e.g., ammonium peroxydisulfate and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidines and asym-triazines, e.g., 2,4-dihydroxypyrimides, 2-hydroxy-4-aminopyrimidine, and azauracil, and tetrazapentalene derivatives, e.g., 3,6-dimercapto-1,4-diphenyl-1H,4H-2,3a,5,6a-tetrazapentalene, and 1,4-di(o-chlorophenyl)-3,6-dimercapto-1H,4H-2,3a,5,6a-tetrazapentalene.

The preferred concentrations of toners are in the range of from 0.01 (most preferably 0.1) to 10 percent by weight, based on the total weight of the photothermographic layer.

Antifoggants and stabilizers for the photosensitive silver halide grains are preferably incorporated in the photothermographic layer. A variety of base generating materials, commonly referred to as activators, are conventionally employed in photothermographic layers to improve development. In order to simplify the coating compositions, activation and stabilization can be combined. Addenda in these classes are illustrated by *Research Disclosure*, Item 17029, cited above, IV. Activators/Activator-Stabilizers/Stabilizers, A. Activators and Activator Precursors, B. Stabilizers and Stabilizer Precursors, and C. Activator/Stabilizers and Activator/Stabilizer Precursors, and VIII. Antifoggants/Post-processing Print-Out Stabilizers.

Specifically preferred antifoggants and stabilizers which can be used alone or in combination, include the thiazolium salts described in Staud, U.S. Pat. No. 2,131,038 and Allen U.S. Pat. No. 2,694,716; the azaindenes described in Piper, U.S. Pat. No. 2,886,437 and Heimbach, U.S. Pat. No. 2,444,605; the mercury salts described in Allen, U.S. Pat. No. 2,728,663; the urazoles described in Anderson, U.S. Pat. No. 3,287,135; the sulfocatechols described in Kennard, U.S. Pat. No. 3,235,652; the oximes described in Carrol et al., British Patent No. 623,448; the polyvalent metal salts described in Jones, U.S. Pat. No. 2,839,405; the thiuronium salts described by Herz, U.S. Pat. No. 3,220,839; and palladium, platinum and gold salts described in Trivelli, U.S. Pat. No. 2,566,263 and Damschroder, U.S. Pat. No. 2,597,915.

Other conventional addenda and photothermographic element features specifically contemplated include the following, illustrated by *Research Disclosure*, Item 17029, cited above:

VII. Development Modifiers
System B.

X. Coating Aids

XI. Overcoat Layers

XII. Interlayer/Barrier Layers

XIV. Filter Dyes/Antihalation Layers

XV. Color Materials

XVII. Supports
A. Paper Supports
B. Film Supports

EXAMPLES

The invention can be better appreciated by reference to the following specific embodiments of the invention:

Emulsion E1

Silver halide emulsion E-1 was precipitated by mixing lithium bromide, silver trifluoroacetate, and poly(vinyl butyral) in acetone under controlled conditions to yield grains having a mean size of 0.07 $\mu$m.

This procedure is known in the art as ex situ silver halide preparation and has been described, for example, in Jones U.S. Pat. No. 3,871,887 at column 9, line 58, through column 10, line 3.

Sensitizers

Chemical sensitizing solutions were prepared as follows:

CSD-1 (comparison)

Chemical sensitizing dispersion CSD-1 was prepared in the following manner: Fifteen grams of an aqueous solution containing 75 mg of the sulfur sensitizer sodium thiosulfate were added to a vigorously agitated solution containing 37 grams of 5% by weight Butvar B76™ in toluene and 2.3 grams of benzyl alcohol. The Butvar B76, according to manufacturer published specifications, has an average molecular weight in the range of from 90 to 120 thousand, a hydroxyl content expressed as mole percent poly(vinyl alcohol) of from 11.0 to 13.0 percent, an acetate content expressed as poly(vinyl acetate) of from 0 to 2.5 percent, and a poly(vinyl butyral) content of 80 percent.

The mixture was agitated with an ultrasonic probe driven at 60 watts for 6 minutes. This resulted in a comparative chemical sensitizing dispersion.

CSD-2 (invention)

The procedure used to prepare CSD-1 was repeated, except that a second sulfur sensitizer, the thiourea S-3 from Table I, was substituted for sodium thiosulfate sulfur sensitizer.

Varied proportions of the sulfur sensitizers, shown in Table II, were added to samples of emulsion E-1. Chemical sensitization was accomplished by heating to 65° C. for fifteen minutes.

One portion (E1-1) of emulsion E1 was employed without adding a chemical sensitizer and without heating.

Another portion (E2-1) of emulsion E1 was subjected to the chemical sensitization heating step, but with no chemical sensitizer added.

Photothermographic Layers

Photothermographic layers of each of the samples examined were coated on a transparent film support. As coated, each layer contained 43 mg/dm$^2$ of poly(vinyl butyral) binder, 2.26 mg/dm$^2$ of silver provided by the silver halide grains, and 11.5 mg/dm$^2$ of silver provided by silver behenate. The coating also contained 14 mg/dm$^2$ of N-(4-hydroxyphenyl)benzenesulfonamide as a developing agent and 2.48 mg/dm$^2$ of succinimide as a development accelerator. The photothermographic compositions also contained 0.68 mg/dm$^2$ of 2-bromo-2-(4-methylphenylsulfonyl) acetamide, 0.16 mg/dm$^2$ of 2,4-bis (trichloromethyl)-6-(1-naphtho)-s-triazine, 0.06 mg/dm$^2$ of dimethyl siloxane, and 0.16 mg/dm$^2$ of palmitic acid. The coating vehicle was a solvent mixture containing methyl iso-butyl ketone, toluene and acetone.

Sensitometry

The coatings were exposed through a 0–4 neutral density step tablet for ⅕" with a 3000° K. light source at 5.09 log lux, followed by thermal processing for six seconds at 120° C.

The sensitometric response of the coatings is summarized in Table II. Speed is reported in relative log units (30 units=0.30 log E, where E represents exposure in lux-seconds) and was measured at a density of 1.0 above minimum density. CSD-1 and CSD-2 concentrations are reported in terms of the mg of sulfur sensitizer per mole of silver halide. Coating C-1 employed emulsion E1-1. The coating prepared with emulsion E1-2, which was heated, but not chemically sensitized, is not listed in Table II. That coating showed higher fog and lower speed than coating C-1.

TABLE II

| Coating | CSD-1 | CSD-2 | $D_{min}$ | Rel. Speed |
|---|---|---|---|---|
| C-1 | 0 | 0 | 0.072 | 100 |
| C-2 | 30 | 0 | 0.08 | 105 |
| C-3 | 60 | 0 | 0.095 | 108 |
| C-4 | 90 | 0 | 0.11 | 95 |
| C-5 | 120 | 0 | 0.10 | 105 |

TABLE II-continued

| Coating | CSD-1 | CSD-2 | $D_{min}$ | Rel. Speed |
|---|---|---|---|---|
| C-6 | 0 | 60 | 0.092 | 137 |
| C-7 | 0 | 120 | 0.114 | 128 |
| C-8 | 0 | 180 | 0.221 | 145 |

From Table II it is apparent that the conventional sulfur sensitizer sodium thiosulfate was only marginally effective in increasing speed. By contrast the tetra-substituted thiourea sensitizer S-3 offered a significant increase in photosensitivity.

Aqueous vs. Non-aqueous Emulsions

An additional chemical sensitization dispersion was prepared as follows:

CSD-3

The procedure used to prepare CSD-1 was repeated, except that a conventional sulfur and gold sensitizer, sodium aurous dithiosulfate, was substituted for the sodium thiosulfate sulfur sensitizer.

Aqueous Gelatin Peptized Emulsion E2

A conventional silver bromide emulsion was precipitated in an aqueous medium containing gelatin as a peptizer to provide silver halide grains having a mean size of 0.07 $\mu$m, matching the mean grain size of Emulsion E1.

Samples of Emulsions E1 and E2 were chemically sensitized as described above using 29 mg of sensitizer in CSD-1 per mole of silver halide and 73 mg of sensitizer in CSD-3 per mole of silver halide. The sensitized emulsions were formulated into photothermographic coatings and described above and similarly exposed and processed. The results are compared in Table III.

TABLE III

| Emulsion | $D_{min}$ | Rel. Speed |
|---|---|---|
| E1 (non-aqueous) | 0.083 | 100 |
| B2 (aqueous) | 0.34 | 35 |

From Table III it is apparent that the procedure of dispersing the chemical sensitizer in an aqueous medium and then adding to a silver halide emulsion in which the grains are suspended in a non-aqueous medium produces superior results to employing a conventional aqueous gelatino-peptized silver halide emulsion for chemical sensitization. This runs exactly counter to what would be expected, based on the common knowledge that aqueous silver halide emulsions produce higher photographic speeds than those attainable in non-aqueous photothermographic systems.

The invention has been described in detail with particular reference to preferred embodiments thereof, but it will be understood that variations and modifications can be effected within the spirit and scope of the invention.

What is claimed is:

1. A process of preparing a photothermographic composition of enhanced photosensitivity comprised of (a) precipitating light-sensitive silver halide grains in the presence of a non-aqueous polymeric peptizer and (b) then combining the silver halide grains with a non-aqueous polymeric vehicle containing an oxidation-reduction image-forming combination comprised of an organic silver compound and a reducing agent for the organic silver compound, wherein light-sensitivity of the silver halide grains is enhanced by, prior to step (b), sensitizing the silver halide grains with a 1,1,3,3-tetra-substituted thiourea or selenourea having an acid dissociation constant of less than 7.0, the thiourea or selenourea being dissolved in an aqueous medium.

2. A process according to claim 1 wherein at least one of the non-aqueous polymeric peptizer and non-aqueous polymeric vehicle are comprised of a vinyl acetal polymer.

3. A process according to claim 2 wherein the vinyl acetal polymer is a vinyl butyral polymer.

4. A process according to claim 1 wherein the 1,1,3,3-tetra-substituted thiourea or selenourea has an acid dissociation constant in the range of from 2.0 to 5.0.

5. A process according to claim 1 wherein the 1,1,3,3-tetra-substituted sensitizer is a thiourea.

6. A process according to claim 1 wherein the 1,1,3,3-tetra-substituted sensitizer satisfies the formula:

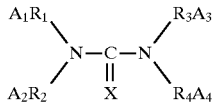

wherein

X is sulfur or selenium;

each of $R_1$, $R_2$, $R_3$ and R4 independently represents a hydrocarbon linking group containing from 1 to 10 carbon atoms;

$A_1$ and $A_2$ together contain the non-metallic atoms necessary to complete with $R_1$ and $R_2$ a 5 or 6 member ring or independently represent hydrogen or an acidic group; and $A_3$ and $A_4$ independently represent hydrogen or a radical comprising an acidic group;

with the proviso that at least one of $A_1$ to $A_4$ is an acidic group.

7. A process according to claim 6 wherein X is sulfur and each of $R_1$, $R_2$, $R_3$ and $R_4$ independently represents a hydrocarbon linking group containing from 1 to 6 carbon atoms.

8. A process according to 1 wherein stirring and heating occurs during the step of chemical sensitization.

9. A photothermographic composition comprised of (a) photosensitive silver halide grains;

(b) an oxidation-reduction image-forming combination comprised of (i) an organic silver compound and (ii) an organic reducing agent; and (c) a non-aqueous polymeric dispersing medium, wherein the silver halide grains formed in a non-aqueous polymeric peptizer and chemically sensitized with a 1,1,3,3-tetra-substituted thiourea or selenourea having an acid dissociation constant of less than 7.0 the thiourea or selenourea being dissolved in aqueous medium.

10. A photothermographic composition according to claim 9 wherein the non-aqueous polymeric dispersing medium is comprised of a vinyl acetal polymer.

11. A photothermographic composition according to claim 10 wherein the vinyl acetal polymer is a vinyl butyral polymer.

12. A photothermographic composition according to claim 11 wherein the vinyl butyral polymer contains, on a mole basis, repeating units that are from 80 to 88 percent provided by vinyl butyral monomer, from 10 to 20 percent provided by vinyl acetate monomer, and from 0 to 2.5 percent provided by vinyl alcohol monomer.

13. A photothermographic composition according to claim 9 wherein the 1,1,3,3-tetra-substituted thiourea or selenourea has an acid dissociation constant in the range of from 2.0 to 5.0.

14. A photothermographic composition according to claim 9 wherein the 1,1,3,3-tetra-substituted sensitizer is a thiourea.

15. A photothermographic composition according to claim 9 wherein the 1,1,3,3-tetra-substituted sensitizer satisfies the formula:

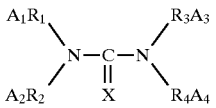

wherein

X is sulfur or seleniurn;

each of $R_1$, $R_2$, $R_3$ and $R_4$ independently represents a hydrocarbon linking group containing from 1 to 10 carbon atoms;

$A_1$ and $A_2$ together contain the non-metallic atoms necessary to complete with $R_1$ and $R_2$ a 5 or 6 member ring or independently represent hydrogen or an acidic group; and $A_3$ and $A_4$ independently represent hydrogen or a radical comprising an acidic group;

with the proviso that at least one of $A_1$ to $A_4$ is an acidic group.

16. A photothermographic composition according to claim 15 wherein X is sulfur and each of $R_1$, $R_2$, $R_3$ and $R_4$ independently represents a hydrocarbon linking group containing from 1 to 6 carbon atoms.

17. A photothermographic composition according to claim 9 wherein the acidic group is chosen from the class consisting of —C(O)OH, —$SO_2$OH and —$SO_3$OH.

* * * * *